US005573308A

United States Patent [19]

Simons et al.

[11] Patent Number: 5,573,308

[45] Date of Patent: Nov. 12, 1996

[54] CUTTING ELEMENT AND HOLDER FOR A COAL CUTTING MACHINE

[75] Inventors: Dieter Simons, Buchholz; Bernd Holl, Neustadt/Wied-Fernthal, both of Germany

[73] Assignee: Wirtgen GmbH, Germany

[21] Appl. No.: 397,095

[22] PCT Filed: Jul. 1, 1994

[86] PCT No.: PCT/EP94/02165

§ 371 Date: May 26, 1995

§ 102(e) Date: May 26, 1995

[87] PCT Pub. No.: WO95/02113

PCT Pub. Date: Jan. 19, 1995

[30] Foreign Application Priority Data

Jul. 6, 1993 [DE] Germany ..... 43 22 402.4

[51] Int. Cl.[6] ..... E21C 35/193

[52] U.S. Cl. ..... 299/102; 299/87.1

[58] Field of Search ..... 299/87.1, 102

[56] References Cited

U.S. PATENT DOCUMENTS

| | | | |
|---|---|---|---|
| 3,695,726 | 10/1972 | Krekeler | 299/106 |
| 4,068,897 | 1/1978 | Amoroso | 299/102 |
| 5,322,351 | 6/1994 | Lent | 299/102 |

FOREIGN PATENT DOCUMENTS

| | | |
|---|---|---|
| 2716177 | 10/1977 | Germany . |
| 9211739 | 12/1992 | Germany . |
| 9310022 | 11/1993 | Germany . |
| 956513 | 4/1964 | United Kingdom . |
| 2237310 | 5/1991 | United Kingdom . |

*Primary Examiner*—David J. Bagnell

*Attorney, Agent, or Firm*—Speckman, Pauley & Fejer

[57] ABSTRACT

A cylindrical cutting element for a coal cutting machine with a reamer-conveyor worm or reamer spiral for a coal cutting, disposed projecting at a distance from the surface of the cutting element and comprising base elements attached at uniform distances. A chisel holder with an exchangeable chisel is connected to each base element. The chisel holder is inserted with its plug-in connector into a socket of the base element and is maintained therein by a pressure screw. A time-saving assembly of a cutting element, wherein the base elements can be positioned on and fastened to the surface of the cutting element in a simple manner is attained where receiver pockets are cut along the reamer-conveyor worm or reamer spiral at uniform distances into the surface of the cutting element, the undersides of the base elements end in a base whose cross section is matched to the receiver pockets, and the base elements are introduced, positioned by the base, into a receiver pocket and are fixedly connected thereto.

13 Claims, 1 Drawing Sheet

CUTTING ELEMENT AND HOLDER FOR A COAL CUTTING MACHINE

BACKGROUND OF THE INVENTION

1. Field of the Invention

This invention relates to a cylindrical cutting element for a coal cutting machine with a reamer-conveyor worm or reamer spiral, disposed projecting at a distance from the surface of the cutting element and made of base elements attached at uniform distances. A chisel holder with an exchangeable chisel is connected to each base element. The chisel holder is inserted with its plug-in connector into a socket of the base element and is maintained therein by a pressure screw.

2. Description of Prior Art

A cutting element of this type is taught by German reference DE 92 11 739 U1. It is necessary to prepare a welding template which is positioned and fastened on the surface of the cutting element. The positions of the individual base parts as well as their alignment on the cutting element are marked. The base parts can then be held and welded on in sequence, so that the reamer-conveyor worm or reamer spiral is produced.

This method is very time-consuming, because it is necessary to produce an individual welding template and to apply it very exactly to the cylindrical cutting element. There is often the danger that the template is placed with insufficient accuracy or that the individual base parts are inaccurately placed for being welded together. This leads to an unsatisfactory geometry of the reamer-conveyor worm or reamer spiral and results in a reduction of the quality of the surfaces milled by the coal cutting machine. Furthermore, the service life of the cutting element is greatly reduced by inexpertly applied base parts, because the forces transmitted through the chisel are not guided through the support surfaces provided, so that the chisel holder is more easily torn off.

SUMMARY OF THE INVENTION

It is an object of this invention to produce a cutting element of the previously mentioned type which provides for a time-saving and precise assembly of the components in a simple way.

This object of this invention is attained by a cutting element having receiver pockets cut along the reamer-conveyor worm or reamer spiral at uniform distances into the surface of the cutting element. The undersides of the base elements end in a base whose cross section is matched to the receiver pockets. The base elements are introduced, positioned by the base, into the receiver pockets and are fixedly connected therewith.

The individual base elements are disposed directly on the cutting element in the prescribed position by means of the receiver pockets and are fastened thereon. Such a procedure for producing a cutting element can be performed by a single person in a time-saving manner and with great accuracy.

In accordance with one embodiment of the cutting element of this invention, the base parts are supported by the undersides of their bases on support surfaces of the receiver pockets. With this type of support, it is possible to absorb very large forces acting normally in relation to the surface of the cutting element.

In accordance with another embodiment of this invention, the base elements are inserted into the receiver pockets until they contact the surface of the cutting element. In this case, the base element has a base which tapers in cross section. In this way, a shoulder is formed by which the base element is easily introduced from above into the receiver pocket.

In accordance with one embodiment of this invention, the accurate positioning of the base elements is provided where the receiver pockets are open in the back, viewed in the movement direction, and the base elements can be slid in the movement direction of the cutting element until they contact the faces of the receiver pockets which are in front, viewed in the movement direction.

The base element in accordance with one embodiment is welded to the cutting element. In accordance with another embodiment, threaded receivers are cut into the cutting element, into which fastening screws can be inserted for fixing the base element in place.

The chisels can be placed very closely together in accordance with one embodiment of this invention where the base elements are arranged in a row in the reamer-conveyor worm or reamer spiral. With a cutting element for a coal cutting machine produced in this manner, it is possible to machine very smooth surfaces.

A space-saving construction is achieved in accordance with one embodiment of this invention where the pressure screw is embodied as a threaded bolt with a tool receptacle at the end. This has the additional advantage that the tool receptacle is protectively housed.

In accordance with one preferred embodiment of this invention, the base elements and the chisel holders are forged, hardened and tempered.

BRIEF DESCRIPTION OF THE DRAWINGS

This invention will be described in detail below by means of an exemplary embodiment of a cutting element shown in the drawings, wherein.

DESCRIPTION OF PREFERRED EMBODIMENTS

Figure 1B:
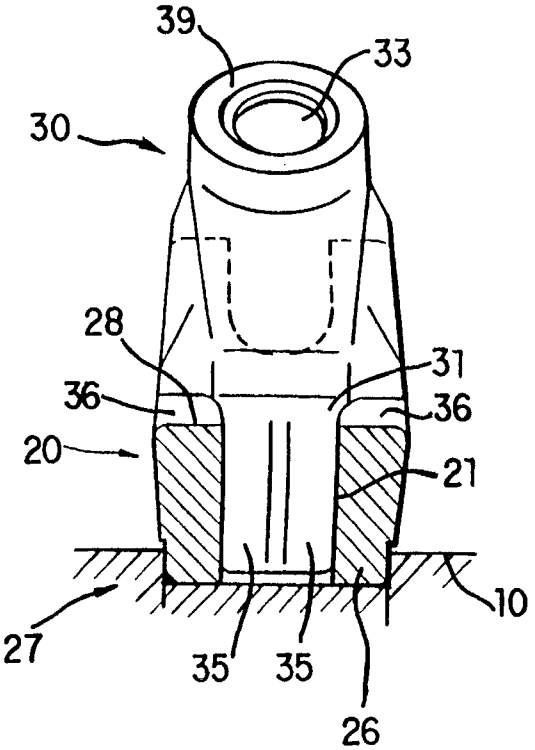
FIGS. 1*a*,1*b*,and 1*c*,are a side view, a front view and a plan view, respectively, of a base element and chisel holder of a cutting element in accordance with one embodiment of this invention.
Figure 1A:
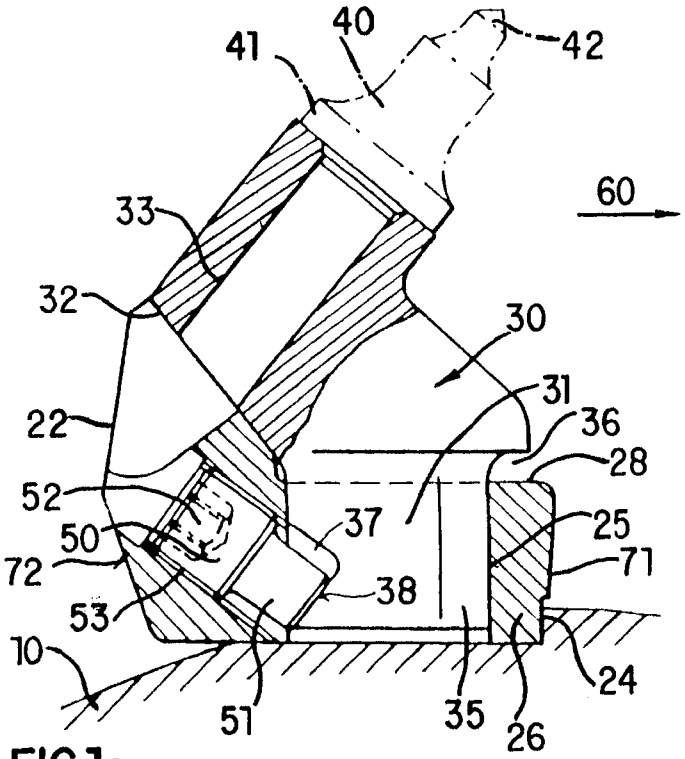
Figure 1C:
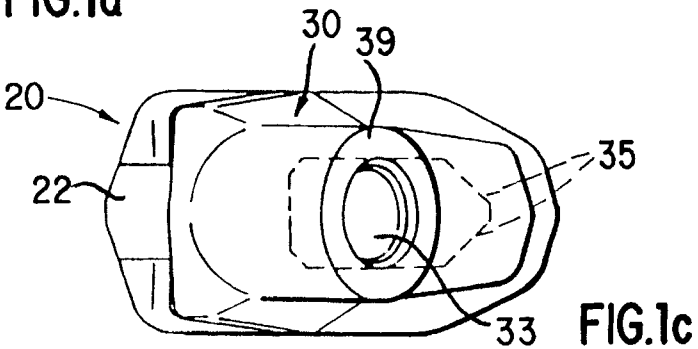

A base element 20 with an exchangeable chisel holder 30 is represented in three views in the drawings. On its surface, the cutting element 10 forms receiver pockets 27 into which the base elements 20 are inserted by their base 26 which tapers in cross section. With the underside of its base 26, the base element 20 is supported against support faces of the receiver pockets 27. The inserting movement of the base element 20 into the receiver pocket 27 is limited by a detent 24 which fixes the base element 20 on its front face. A weld is provided on the cutting element 10 for the secure fastening of the base element 20. The base element 20 forms a socket 21 which has been cut into a shoulder 28 disposed approximately parallel with the movement direction 60 of the cutting element 10. A detent 32 is formed at an obtuse angle at the back, viewed in the movement direction 60, of the base element 20. The chisel holder 30 is inserted into the socket 21 of the base element 20 with its plug-in connector 31. A Vee guide 25 is formed in the front face of the socket 21 and is used for guiding and receiving guide faces 35 of the plug-in connector 31. The insertion movement of the chisel holder 30 is limited by a detent surface facing the detent 32 of the base element 20. A distance 36 is provided in this way between the shoulder 28 of the base element 20 and the side of the chisel holder 30 facing the shoulder 28, so that the chisel holder 30 is only supported on the detent 32. In its rear area, the plug-in connector 31 has a V-shaped recess 37, whose one leg is used as a pressure face 38 for a pressure screw 50. The pressure screw 50 is screwed into the threaded receiver of the base element 20, with its thread 53, so that its cone 51 cooperates with the pressure surface 38. When the pressure screw 50 is tightened, the plug-in connector 31 is drawn into the socket 21 and is simultaneously pressed into the front-side Vee guide 25. A chisel receptacle 33 is formed by the chisel holder 30 and is used as a socket for a shaft element of a chisel 40. A ring-shaped contact face 39 is provided on the side of the chisel receptacle 33 facing the chisel head 42, on which the chisel 40 is supported by a collar 41. The chisel 40 is secured against axial lifting by a clamping sleeve, not shown in the drawings. A tool opening 22 is formed in the base element 20 at the end of the chisel receptacle 33 facing away from the contact face 39, which provides access to the end of the chisel shaft facing away from the chisel head 42. In this way, it is possible to drive the chisel 40 out of the chisel receptacle 33 from the back of the base element 20 with a rod and a hammer. The pressure screw 50 is embodied as a headless grub screw so that it does not extend into the tool opening 22 and, thus, does not hamper a tool change. A tool receptacle 52 is formed in the front face of the pressure screw 50, for example, for receiving an Allen wrench or a torque wrench.

The base elements are fastened, arranged in a row, on the surface of the cutting element 10 to form a reamer-conveyor worm or reamer spiral. In the process, the front contact point 71 of a base element 20 is placed against the rear contact point 72 of a further base element 20 and fastened on the cutting element.

In the exemplary embodiment, the base element 20 is welded to the surface of the cutting element 10. However, it is also conceivable to provide a screw connection.

An alternative, not represented in the drawings, for fastening base elements 20 on the cutting element 10 provides for the receiver pockets 27 to be embodied as blind bore-like depressions in the surface of the cutting element 10, into which the base element 20 is inserted with its base 26. In this case, the base 26 can taper in cross section and be set off in relation to the base element 20. The base 26 is then supported on the surface of the cutting element 10 by the shoulder formed in this way.

We claim:

1. In a cylindrical cutting element for a coal cutting machine having a reamer-conveyor worm or reamer spiral for cutting, disposed projecting at a distance from the surface of the cutting element and comprising a plurality of base elements attached at uniform distances, a chisel holder with an exchangeable chisel connected to each said base element, said chisel holder having a plug-in connector inserted into a socket of the base element and maintained therein by a pressure screw, the improvement comprising:

the surface of said cutting element forming a plurality of receiver pockets (27) along the reamer-conveyor worm or reamer spiral at uniform distances;

an underside of each of said base elements (20) terminating in a base (26) whose cross section corresponds to said plurality of receiver pockets (27); and each of said base elements (20) disposed by means of the base (26) in one of said receiver pockets (27) and fixedly connected thereto.

2. In a cutting element in accordance with claim 1, wherein each of the base parts (20) is supported by the underside of its base (26) on a support surface of one of the receiver pockets (27).

3. In a cutting element in accordance with claim 1, wherein each of the base elements (20) is insertable into one of the receiver pockets (27) until it contacts with a cutting element surface of the cutting element (10).

4. In a cutting element in accordance with claim 3, wherein each of the receiver pockets (27) has an open back, viewed in the movement direction of said cutting element, and each of the base elements (20) is slidable in the movement direction of the cutting element until it contacts a front face of the receiver pocket (27), viewed in the movement direction.

5. In a cutting element in accordance with claim 4, wherein the base (26) of each of the base elements (20), after insertion into the receiver pocket (27), is one of welded and screwed to the surface of the cutting element.

6. In a cutting element in accordance with claim 5, wherein the base elements (20) are arranged in a row in the reamer-conveyor worm or reamer spiral.

7. In a cutting element in accordance with claim 6, wherein the pressure screw is embodied as a threaded bolt (50) with a tool receptacle (52) at one end.

8. In a cutting element in accordance with claim 7, wherein the base elements (20) and the chisel holders (30) are forged, hardened and tempered.

9. In a cutting element in accordance with claim 1, wherein each of the receiver pockets (27) has an open back, viewed in the movement direction of said cutting element, and each of the base elements (20) is slidable in the movement direction of the cutting element until it contacts a front face of the receiver pocket (27), viewed in the movement direction.

10. In a cutting element in accordance with claim 1, wherein the base (26) of each of the base elements (20), after insertion into the receiver pocket (27), is one of welded and screwed to the surface of the cutting element.

11. In a cutting element in accordance with claim 1, wherein the base elements (20) are arranged in a row in the reamer-conveyor worm or reamer spiral.

12. In a cutting element in accordance with claim 1, wherein the pressure screw is embodied as a threaded bolt (50) with a tool receptacle (52) at one end.

13. In a cutting element in accordance with claim 1, wherein the base elements (20) and the chisel holders (30) are forged, hardened and tempered.

* * * * *